United States Patent [19]

Graf

[11] Patent Number: 4,511,976

[45] Date of Patent: Apr. 16, 1985

[54] PRESS BRAKE HAVING SPRING BACK COMPENSATION STROKE REVERSAL CONTROL

[75] Inventor: Raymond J. Graf, Cincinnati, Ohio

[73] Assignee: Cincinnati Incorporated, Cincinnati, Ohio

[21] Appl. No.: 395,792

[22] Filed: Jul. 6, 1982

[51] Int. Cl.[3] ..... G06F 15/46; B21D 5/02

[52] U.S. Cl. ..... 364/474; 72/21; 72/389; 72/702; 364/476

[58] Field of Search ..... 364/472, 476, 142, 474, 364/475; 72/7-10, 21, 22, 389, 702

[56] References Cited

U.S. PATENT DOCUMENTS

| | | | |
|---|---|---|---|
| 3,145,756 | 8/1964 | Hill | 153/20 |
| 3,156,287 | 11/1964 | Munro | 153/10 |
| 3,181,331 | 5/1965 | Wishing | 72/215 |
| 3,333,445 | 8/1967 | Mergler | 72/9 |
| 3,352,136 | 11/1967 | Clarke | 72/9 |
| 3,459,018 | 8/1969 | Miller | 72/7 |
| 3,553,990 | 1/1971 | Suding et al. | 72/8 |
| 3,564,883 | 2/1971 | Koors et al. | 72/8 |
| 3,620,066 | 11/1971 | Henkel et al. | 72/362 |
| 3,653,251 | 4/1972 | Coonan | 72/369 |
| 3,713,312 | 1/1973 | Galdabini | 72/10 |
| 3,729,969 | 5/1973 | Gibson et al. | 72/127 |
| 3,777,525 | 12/1973 | Peddinghaus | 72/22 |
| 3,812,694 | 5/1974 | Peddinghaus | 72/21 |
| 3,821,525 | 6/1974 | Eaton et al. | 235/151.1 |
| 3,895,509 | 7/1975 | Peddinghaus | 72/21 |
| 3,943,746 | 3/1976 | Eitel et al. | 72/702 X |
| 3,948,076 | 4/1976 | Eitel et al. | 72/702 X |
| 3,955,389 | 5/1976 | Foster | 72/9 |
| 4,148,203 | 4/1979 | Farazandeh et al. | 72/21 |
| 4,408,471 | 10/1983 | Gossard et al. | 72/21 |

OTHER PUBLICATIONS

ICAM Integrated Computer Aided Manufacturing, presented at 4th Annual Industry Briefing, Sep. 11, 1979, Southfield, Michigan, pp. 503-506.

ICAM Mathematical Modeling of Sheet Metal Formability Indices and Sheet Metal Forming Processes, AFML-TR-79-4168, Nov. 1979, pp. 235-237, by Air Force Materials Laboratory.

*Primary Examiner*—Joseph Ruggiero

*Attorney, Agent, or Firm*—Frost & Jacobs

[57] ABSTRACT

An electronic control system for use with hydraulic press brakes to provide compensation for material spring back to accurately produce a desired bend angle in the work piece. The ram force and flank angle of the work piece are monitored during the forming cycle to calculate the theoretical unloading curve of the work piece. Intersection of the plastic portion of the work piece force-angle curve with the theoretical unloading curve provides a calculated point of ram reversal resulting in the desired bend angle. The system compensates for changes in springback resulting from changes in material properties from one work piece to the next.

25 Claims, 4 Drawing Figures

PRESS BRAKE HAVING SPRING BACK COMPENSATION STROKE REVERSAL CONTROL

SUMMARY OF THE INVENTION

The present invention is directed to a control system for press brakes, and more particularly to a control system for use with hydraulic press brakes to predict the point of stroke reversal to produce a desired bend angle based upon in-process measurements made during the forming cycle.

A common problem which occurs with conventional press brakes used to bend sheet metal or the like to a predetermined angle is the return or spring back of the material to a position somewhat less than the desired bend upon retraction of the punch member from the die. Generally, the terminal punch position is selected manually by an operator so that the stroke of the ram is reversed at a predetermined point to produce the desired angle of bend. Consequently, the selection of the reversal point by the operator is an artful choice to insure that the metal sheet is overbent just enough to spring back to the desired angle. This procedure is usually based on trial and error coupled with the experience of the press brake operator.

The proper point of stroke reversal for a particular bend angle depends upon the properties of the material, the geometry of the die and punch, and the specific angle desired. This point is often found by making several trial bends to empirically determine the reversal point producing the best bend angle including compensation for spring back. It has been found that once this point is found, it will vary from bend to bend as the material varies in thickness and physical properties.

The present invention includes an electronic control system associated with the press brake which monitors the actual angle of bend of the work piece and the bending load and processes this information to provide a control signal for activating the ram reversal mechanism at the precise point of punch penetration to accurately produce the desired bend angle in the work piece with a single ram stroke. The control system of the present invention may be retrofitted to an existing press brake without modification to the basic brake operating controls.

In a preferred embodiment, the control of the present invention includes a load transducer in the form of a load cell associated with either or both of the ram hydraulic pistons which produces a load signal representative of the instantaneous force supplied to the work piece as well as a sensor in contact with the work piece which measures the actual instantaneous angle of bend, commonly referred to as the flank angle. Using information derived from these two input sources, the instantaneous ram force-flank angle characteristics of the work piece can be continuously monitored.

During the forming cycle, successive ram force-flank angle data point pairs are taken and used to calculate the slope of the elastic portion of the force-angle characteristic curve for that particular work piece. The linearity of the loading portion of the curve is also monitored in order to determine when the plastic portion of the curve is entered. It has been found that the theoretical unloading characteristics may be derived from the measured loading characteristics of the work piece. The slope of the theoretical unloading curve may be calculated using the measured slope of the loading characteristic and the desired or unloaded bend angle.

During the plastic portion of the characteristic curve, additional data point pairs are measured and a slope for this portion of the curve calculated. Using this information, the theoretical intersection point for the linear portion of the plastic curve and the theoretical unloading curve may be calculated. This point corresponds to the calculated loaded flank angle which will produce the desired unloaded flank angle. Consequently, when this point is reached, the ram is reversed allowing the work piece to relax or spring back to the desired flank angle.

In the preferred embodiment, mathematical relationship between the loading and unloading characteristics, and slopes of specific force/displacement/flank angle curves is disclosed which provides accurate results for many types of materials.

Further features of the invention will become apparent from the detailed description which follows.

DETAILED DESCRIPTION

Figure 1:
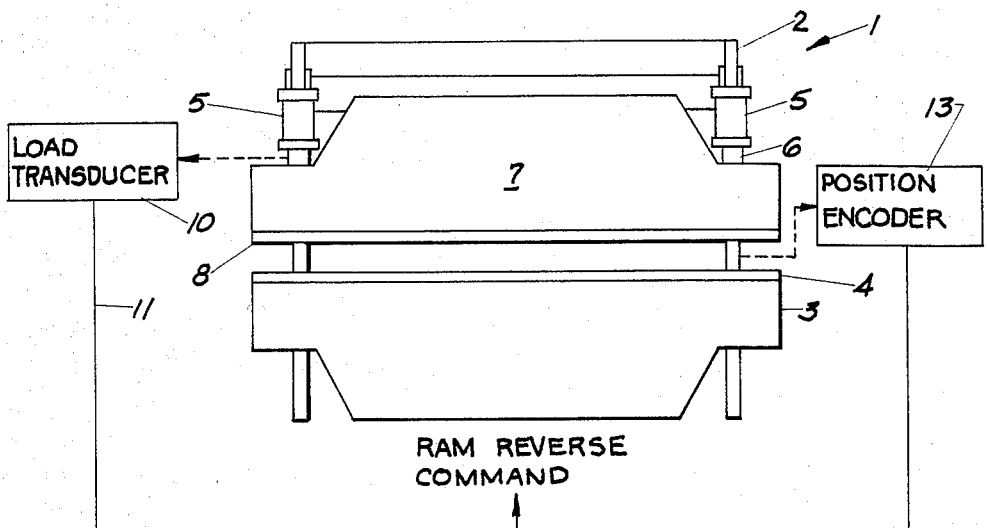
FIG. 1 is a diagrammatic block diagram of the control system of the present invention in connection with a conventional hydraulically operated press brake illustrated in front elevation.

A general block diagram of the control system of the present invention is illustrated generally at 1 in FIG. 1. This arrangement includes a conventional hydraulically operated press brake 2 having a rigid structural frame fixedly mounting a bed 3 supporting a V die 4. Press brake 2 also includes a pair of spaced vertically oriented hydraulically operated cylinders 5 operating piston rods 6 which in turn are connected to a ram member 7. Ram member 7 is vertically displaceable with respect to bed 3 as is well known in the art. The lowermost edge of ram 7 mounts a punch 8 of the proper configuration to enter V die 4 to produce the proper bend.

Figure 2:
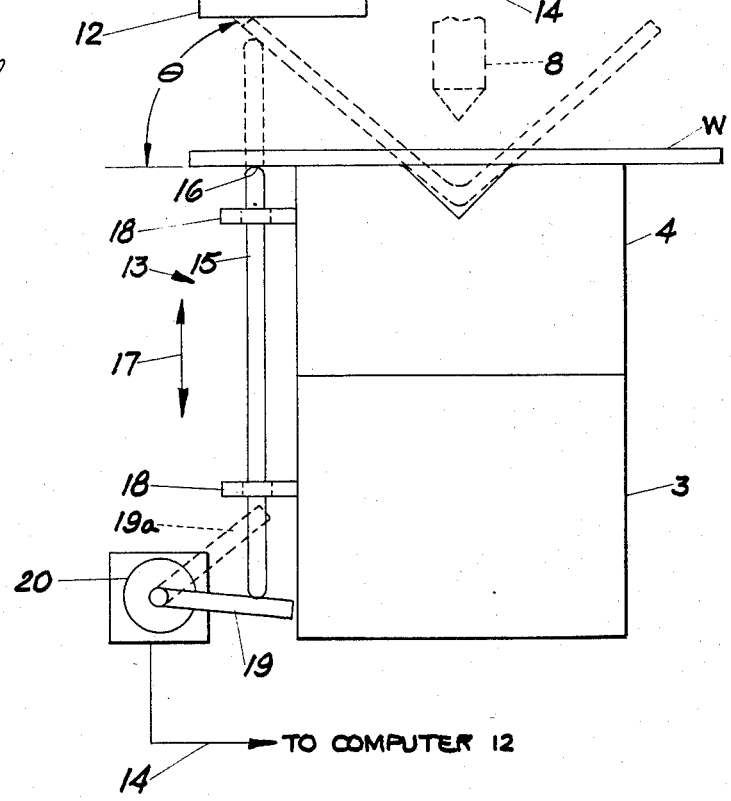
FIG. 2 is a diagrammatic side elevation view of a portion of the press brake of FIG. 1 illustrating the angle measurement mechanism associated with the present invention, with the work piece shown in the bent and unbent positions.

FIG. 2 illustrates diagrammatically a side elevation view of the lower portion of press brake 2. In a typical bending operation, a flat metallic work piece W, illustrated in the relaxed or unbent state, is placed on top of V die 4. As the punch 8 is moved downwardly by the hydraulically controlled brake ram 7, it enters the V-shaped channel of V die 4, bending the work piece W to a particular angle, illustrated in dashed lines in FIG. 2. At the furthest downward extent of travel of punch 8, the work piece W will be bent to a loaded angle, $\theta_l$, somewhat greater than the desired bend or flank angle. As the direction of travel of punch 8 is reversed, work piece W returns to a slightly smaller angle, and when fully unloaded assumes an unloaded flank angle designated $\theta_u$. The amount of "spring back" associated with the work piece W will depend on the particular characteristics and size of the material used, as well as the parameters of the punch and die. It will be observed that a certain degree of downward over travel of the punch 8 is usually necessary to produce a particular desired unloaded flank angle $\theta_u$. The control system of the present invention provides the necessary amount of punch over travel to produce the desired finished bend angle.

Returning to FIG. 1, also associated with press brake 2 is an electro-hydraulic brake control 9 which issues commands to hydraulic circuitry (not shown) associated with hydraulic cylinders 5 for causing ram 7 to move downwardly under control of an electrical ram stroke command, and upwardly under control of a ram reverse command. In the present invention, the downwardly directed ram stroke operates as in a conventional press brake. However, the ram reverse command is modified to cause reversal of the ram at the precise point calculated by the digital processing means to be described hereinafter to insure the proper bend angle.

A load transducer 10 is associated with either or both of piston rods 6 and produces an electrical signal on line 11 proportional to the ram force being exerted against the work piece W. For example, load transducer 10 may comprise a load cell formed from a piece of steel having strain gages arranged at the end of piston rod 6 to form a conventional bridge circuit as described in U.S. Pat. No. 3,564,883, Hydraulic Press Control, issued Feb. 23, 1971 to C. W. Koors et al.

The electrical signal appearing on line 11, which may be of digital format, is applied to digital processing means formed by digital computer 12. In instances where a load transducer 10 is associated with each of hydraulic piston 6, the readings obtained from each transducer may be added to produce an electrical signal proportional to the sum force exerted by ram 7.

The instantaneous flank angle of the work piece W is sensed by a position encoder 13 which applies to digital computer 12 on electrical output line 14 a signal representative of the instantaneous flank angle of the work piece. A specific embodiment of position encoder 13 is illustrated in more detail in FIG. 2 and includes a vertically extending rod 15 having a rounded upper end 16 which remains in physical contact with the undersurface of work piece W. Rod 15 is restrained to move in vertical directions depicted by arrows 17 by means of spaced guide members 18 attached to the frame of press brake 2. The lower end of rod 15 is in contact with a lever arm 19 which has one end fixedly attached to the shaft of a rotary encoder 20. As rod 15 is moved upwardly and the position illustrated in dotted lines as work piece W is moved to a bent position, lever arm 19 correspondingly moves upwardly to the dotted position shown at **19*a*, thereby causing rotation of the shaft associated with rotary encoder 20, and an electrical signal output on line 14** proportional to the angle of bend of the work piece. It will be observed that other methods of measuring the angle of bend of the work piece, both contact and non-contact, such as laser or other optical methods, may also be utilized.

Figure 3:
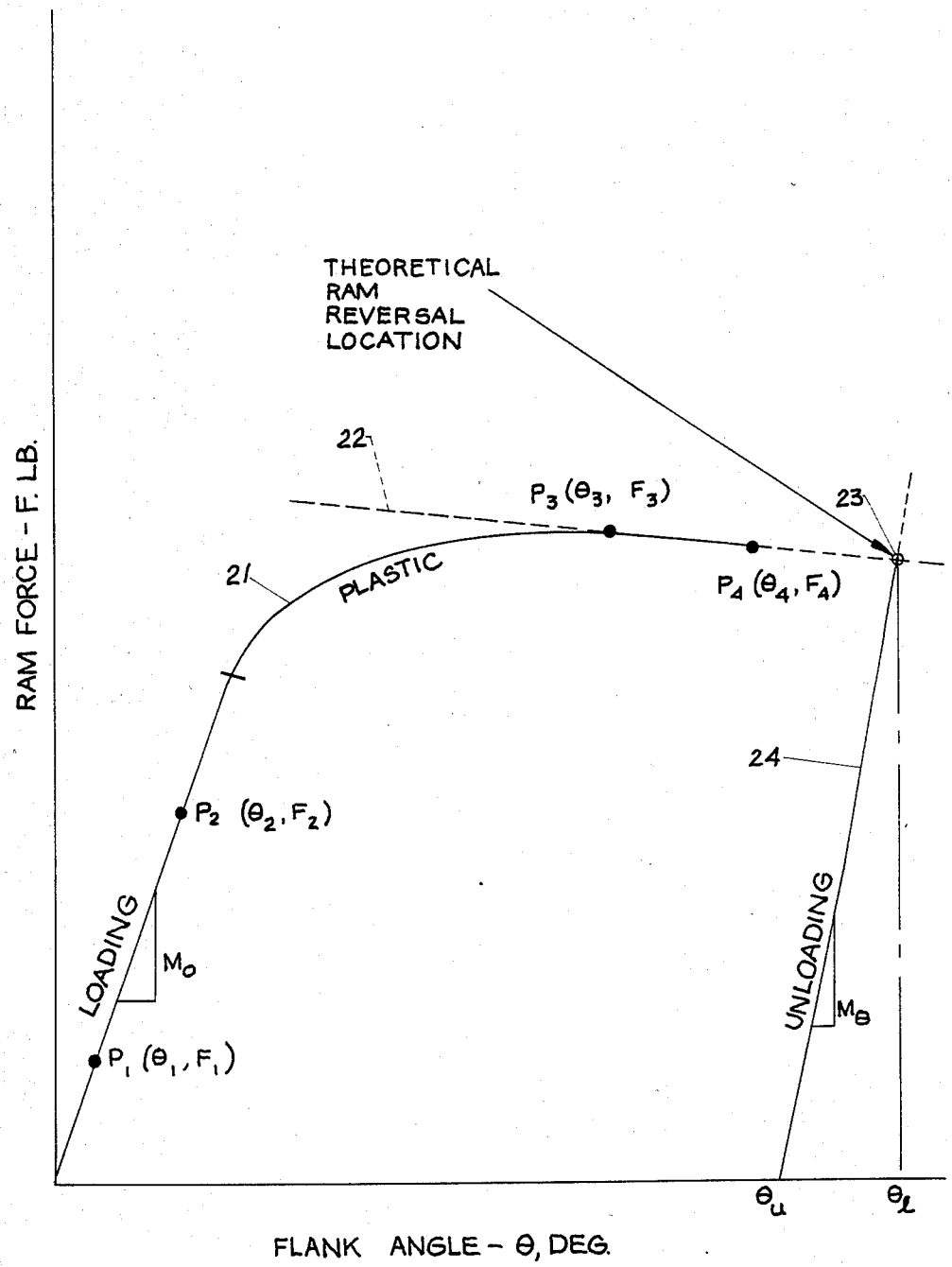
FIG. 3 is a graphical representation of the ram force-flank angle characteristic curve for a typical work piece.

It will be observed that the arrangement just described permits the force exerted by the ram against the work piece as well as the actual flank angle of the work piece to be continuously measured. These measurements will result in a force-angle characteristic of the type graphically illustrated in FIG. 3. The initial linear or elastic region of the curve depicted in FIG. 3 represents the loading characteristics of work piece W. If at any point during this loading portion the ram is reversed, the work piece will return to its normal unbent state. As will be described in more detail hereinafter, during the loading portion of the curve, a number of data points are measured relating ram force to flank angle. For purposes of an exemplary showing, two such data point pairs are illustrated, the first data point $P_1$ relating flank angle $\theta_1$ to ram force $F_1$ and a second data point $P_2$ relating flank angle $\theta_2$ to ram force $F_2$. In the specific processing under consideration, more than two points will be measured so as to provide a continuous representation of the force-angle relationship during the loading portion of the curve.

From this data, the slope $M_O$ of the loading portion for the curve may be calculated, such as by the relationship:

$$M_o = \frac{F_2 - F_1}{\theta_2 - \theta_1}$$

The calculation of the loading slope $M_O$ is terminated when the processing senses that the relationship between the ram force and flank angle is departing from linearity, indicating that the work piece is entering the plastic portion 21 of the curve. Once this has occurred, the process examines data point pairs, depicted as point $P_3$ and $P_4$ in FIG. 3. By relating data point pairs on the linear part of the plastic portion of the curve, an assumed straight line segment 22 can be formulated.

As illustrated in FIG. 3, if the ram is reversed at the theoretical ram reversal location 23, corresponding to a loaded flank angle $\theta_1$, the work piece will relax along the unloading curve 24 to produce the desired flank angle $\theta_u$. From the data already calculated, it is only necessary to know the slope $M_\theta$ of the unloading curve to determine where the ram reversal location 23 should occur. It has been found empirically that a relationship exists between the unloading slope $M_\theta$, the loading slope $M_0$, and the unloaded flank angle $\theta_u$, expressed mathematically in the general form $M_\theta = f(M_O, \theta_u)$. Although this derived expression will vary somewhat for the size of the V die and material, it may be expressed as a third order equation as follows:

$$M_\theta = M_O(k_O + k_1\theta_u + k_2\theta_u^2 + k_3\theta_u^3)$$

where:

$k_O = 1.284$ $k_1 = -1.82291 \times 10^{-2}$ $k_2 = 1.00651 \times 10^{-3}$ $k_3 = -1.69313 \times 10^{-5}$ Once the value of the unloaded slope has been calculated, the loaded flank angle $\theta_1$ corresponding to the point 23 at which the ram should be reversed may be calculated from the expression:

$$\theta_l = \frac{(\theta_4 - \theta_3)(F_3 + M_\theta\,\theta_u) - \theta_3(F_4 - F_3)}{(\theta_4 - \theta_3)M_\theta - (F_4 - F_3)}$$

It will be observed that data for the previous equation is obtained by in-process machine measurements, $P_3$ and $P_4$, as well as a previous calculation for the value $M_\theta$ and user supplied data, $\theta_u$, the unloaded flank angle desired.

Figure 4A:
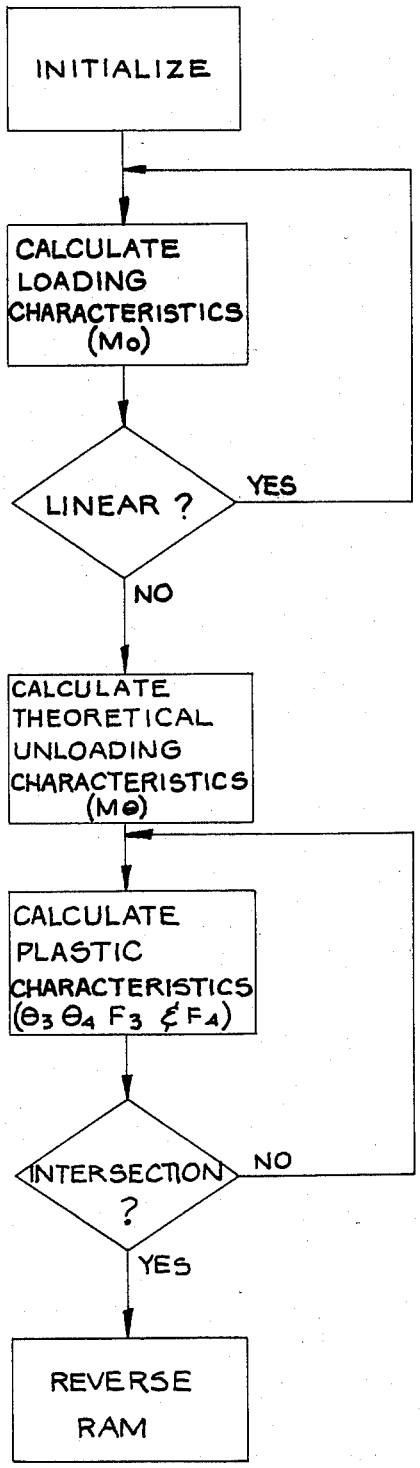
FIG. 4 is a flow diagram for the program associated with computer 12.

A flow diagram for the processing to carry out the above processing in computer 12 is illustrated in FIG. 4. The system is initialized to be certain that the ram force and flank angle start at zero values. The loading characteristics are then calculated by measuring successively a number of ram force-flank angle data pairs as described above, and using this information to calculate the loading slope $M_0$. If the force-angle relationship continues to be linear, the calculation just described continues. However, when non-linearity is noted, indicating that the force-angle characteristic is entering the plastic phase, the processing branches to calculate the theoretical unloading characteristics, specifically the unloading slope $M_\theta$ as described hereinabove based on the measured value of $M_O$ and the desired unloaded flank angle. A value of loading slope $M_O$ calculated before the onset of non-linearity is selected as the value of loading slope used in subsequent calculations.

The plastic characteristics are then calculated by measuring successively a number of data point pairs relating ram force and flank angle in the plastic portion of the curve. These values, together with the value of $M_\theta$ and the desired unloaded flank angle $\theta_u$, are used to determine the point of theoretical ram reversal location. In other words, the processing seeks to determine a point of intersection between linear line segment 22 and the theoretical unloading curve 24. As long as such an intersection has not occurred, the system continues to relate the plastic characteristics to the theoretical unloading curve. However, when an intersection point 23 is detected, computer 14 outputs a signal on line 18 to brake control 9 to reverse the direction of travel of ram 7, thereby terminating the forming operation. At this point, the work piece W, which has been bent to a loaded flank angle $\theta_l$, relaxes or springs back to the desired unloaded flank angle $\theta_u$ along unloading curve 24.

It will be observed that the processing described in FIG. 4 may be used to program a general purpose digital computer, or may be furnished as "firmware" such as a ROM associated with computer 12.

It will be understood that various changes in the details, steps, materials and arrangements of parts, which have been herein described and illustrated in connection with the present invention, may be made by those skilled in the art within the principle and scope of the invention as expressed in the appended claims.

The embodiments of the invention in which an exclusive property or privilege is claimed are as follows:

1. In a press brake for bending a work piece to a desired unloaded flank angle during a forming cycle of the type having a bed supporting a die member, a ram displaceable with respect to said bed, a punch member mounted on the ram and configured to engage the die to produce the desired bend, means for moving said ram toward said bed so that the punch member engages the work piece, and reversing means for reversing the direction of travel of said ram to move the punch member out of engagement with the work piece, the improvement in combination therewith comprising means for reversing the direction of ram travel at the proper point to compensate for work piece spring back and material variations in order to develop the desired unloaded flank angle including means for calculating the loading characteristics of the work piece during the forming cycle, means for deriving from said loading characteristics the theoretical unloading characteristics of the work piece, means for calculating the plastic characteristics of the work piece during the forming cycle, and means for relating said unloading and plastic characteristics to calculate the point of ram penetration at which ram reversal should occur to produce the desired flank angle in the work piece.

2. The apparatus according to claim 1 including means for measuring the actual flank angle of the work piece during the forming cycle.

3. The apparatus according to claim 2 wherein said angle measuring means is configured to contact the work piece.

4. The apparatus according to claim 2 including means for measuring the force exerted against the work piece during the forming cycle.

5. The apparatus according to claim 4 including means for measuring ram force at a first flank angle to develop a first data point, means for measuring ram force at a second flank angle to develop a second data point, and means for calculating the slope of a line extending through said data points to establish the loading characteristics of the work piece.

6. The apparatus according to claim 5 including means for successively calculating the slope between a plurality of pairs of data points.

7. The apparatus according to claim 6 including means for terminating calculation of said slopes when the loading characteristics of the work piece becomes non-linear and means for selecting a slope value prior to the onset of said non-linearity.

8. The apparatus according to claim 5 wherein said deriving means comprises means for calculating the theoretical slope of the unloading portion of the ram force-flank angle curve for the work piece from said selected slope and desired unloaded angle.

9. The apparatus according to claim 8 wherein said theoretical slope $M_\theta$ is calculated according to the relationship $$M_\theta = M_O(k_O + k_1\theta_u + k_2\theta_u^2 + k_3\theta_u^3)$$

where $k_o$, $k_1$, $k_2$ and $k_3$ are preselected fixed constants.

10. The apparatus according to claim 9 wherein $k_0$ is about 1.284, $k_1$ is about $-1.82291\times10^{-2}$, $k_2$ is about $1.00651\times10^{-3}$ and $k_3$ is about $-1.69313\times10^{-5}$.

11. The apparatus according to claim 8 wherein said plastic characteristic calculating means comprises means for measuring during the forming cycle the ram force at a first flank angle to establish a third data point in the plastic phase of the work piece, means for measuring the ram force at a second flank angle to establish a fourth data point in the plastic phase of the work piece, and means for calculating the slope of a line extending through said third and fourth data points to establish the plastic characteristic of the work piece.

12. The apparatus according to claim 11 including means for calculating a straight line segment having a slope equal to said theoretical slope and a zero ram force coordinate equal to the desired flank angle, and means for calculating when said calculated line segment intercepts the plastic portion of the work piece bend curve to establish the loaded flank angle value which corresponds to said ram reversal penetration point.

13. A method for bending a work piece to a desired unloaded flank angle $\theta_u$ during a forming cycle comprising the steps of:

commencing to bend the work piece;

calculating the loading characteristics of the work piece during the forming cycle;

deriving from said loading characteristics the theoretical unloading characteristics of the work piece;

calculating the plastic characteristics of the work piece during the forming cycle;

calculating from said unloading characteristics, said plastic characteristics and said unloaded flank angle a loaded flank angle value; and ceasing to bend the work piece at said loaded flank angle value such that said work piece when unloaded will produce the desired unloaded flank angle.

14. The method according to claim 13 including the step of measuring the actual flank angle and force exerted against the work piece during the forming cycle and utilizing said measured values to calculate said loading and plastic characteristics.

15. The method according to claim 14 including measuring force at a first flank angle to develop a first data point on the work piece loading curve, measuring force at a second flank angle to develop a second data point on the work piece loading curve, and calculating the slope of a straight line extending through said data points comprising said loading characteristic.

16. The method according to claim 15 including measuring force and angle at a plurality of data points and calculating therefrom a plurality of slope values, terminating said slope calculations when the work piece loading curve becomes non-linear, and selecting as said straight line slope value a slope value calculated prior to the onset of non-linearity.

17. The method according to claim 15 wherein said theoretical slope value is calculated from said loading slope.

18. The method according to claim 17 wherein said theoretical slope $M_\theta$ is calculated according to the relationship:

$$M_\theta = M_o(k_O + k_1\theta_u + k_2\theta_u^2 + k_3\theta_u^3)$$

where $k_O$, $k_1$, $k_2$ and $k_3$ are preselected fixed constants.

19. The method according to claim 18 wherein $k_0$ is about 1.284, $k_1$ is about $-1.82291\times10^{-2}$, $k_2$ is about $1.00651\times10^{-3}$, and $k_3$ is about $-1.69313\times10^{-5}$.

20. The method according to claim 17 wherein said plastic characteristics are calculated during the forming cycle by measuring in the plastic phase of the work piece the force at a first flank angle to establish a third data point, measuring in the plastic phase of the work piece the force at a second flank angle to establish a fourth data point, and calculating the slope of a straight line extending through said third and fourth data points to establish the plastic characteristics of the work piece.

21. The method according to claim 20 including the step of calculating a straight line segment having a slope equal to said theoretical slope and a zero force coordinate equal to the desired flank angle, and calculating when said calculated line segment intercepts the plastic portion of the work piece bend curve to establish the loaded flank angle value.

22. In a press brake for bending a work piece to a desired unloaded flank angle during a forming cycle of the type having a bed supporting a die member, a ram displaceable with respect to said bed, a punch member mounted on the ram and configured to engage the die to produce the desired bend, means for moving said ram toward said bed so that the punch member engages the work piece, and reversing means for reversing the direction of travel of said ram to move the punch member out of engagement with the work piece, the improvement in combination therewith comprising means for reversing the direction of ram travel at the proper point to compensate for work piece spring back in order to develop the desired unloaded flank angle including means for measuring the actual force exerted by the ram against the work piece and the actual flank angle of the work piece during the forming cycle to derive therefrom the succession of data points characteristic of the plastic characteristics of the work piece; means for deriving from said measured force and angle data a relationship corresponding to the unloading characteristics of the work piece; means for calculating a point of intersection between said work piece relationships; and means for reversing the direction of ram travel at a measured flank angle corresponding to said intersection point to produce the desired flank angle in the work piece.

23. A method for bending a work piece to a desired unloaded flank angle $\theta_u$ during a forming cycle comprising the steps of:

commencing to bend the work piece;

measuring the actual force exerted against the work piece and the actual flank angle of the work piece during the forming cycle to derive therefrom a relationship representing the plastic characteristics of the work piece;

deriving from said measured force and angle data the relationship corresponding to the unloading characteristics of the work piece;

calculating a point of intersection between said relationships; and ceasing to bend the work piece at a measured flank angle corresponding to said point of intersection.

24. The apparatus according to claim 11 including means for calculating a loaded flank angle $\theta_l$ according to the relationship $$\theta_l = \frac{(\theta_4 - \theta_3)(F_3 + M_\theta\,\theta_u) - \theta_3(F_4 - F_3)}{(\theta_4 - \theta_3)M_\theta - (F_4 - F_3)}$$

where $F_3$ and $\theta_3$ represent the force and angle, respectively, associated with said third data point, $F_4$ and $\theta_4$ represent the force and angle, respectively, associated with said fourth data point, and $M_0$ represents said calculated slope value.

25. The method according to claim 21 including calculating the loaded flank angle $\theta_l$ according to the relationship:

$$\theta_l = \frac{(\theta_4 - \theta_3)(F_3 + M_\theta\,\theta_u) - \theta_3(F_4 - F_3)}{(\theta_4 - \theta_3)M_\theta - (F_4 - F_3)}$$

where $F_3$ and $M_\theta$ represent the force and angle, respectively, associated with said third data point, $F_4$ and $M_\theta$ represent the force and angle, respectively, associated with said fourth data point, and $M_\theta$ represents said calculated slope.

* * * * *